United States Patent [19]

Chace et al.

[11] 3,931,484

[45] Jan. 6, 1976

[54] LEVER OPERATED LIMIT SWITCH HAVING A MECHANISM TO INCREASE OVERTRAVEL

[75] Inventors: Richard Lincoln Chace, Bloomington; John Augustine Kilcoin; William Semonchik, both of Normal, all of Ill.

[73] Assignee: General Electric Company, New York, N.Y.

[22] Filed: Dec. 23, 1974

[21] Appl. No.: 535,668

[52] U.S. Cl. ..... 200/47; 74/107

[51] Int. Cl.[2] ..... H01H 3/16

[58] Field of Search ..... 200/47, 153 L, 153 LA, 200/153 LB; 74/107, 469, 568

[56] References Cited

UNITED STATES PATENTS

| | | | |
|---|---|---|---|
| 3,512,422 | 5/1970 | Aslan | 200/47 |
| 3,829,637 | 8/1974 | Kilcoin | 200/47 |

*Primary Examiner*—Herman Hohauser
*Attorney, Agent, or Firm*—Walter C. Bernkopf; Robert A. Cahill; Frank L. Neuhauser

[57] ABSTRACT

A rotary lever operated limit switch for indicating when a device reaches a limiting position. The switch is comprised of a motion converter at least partially disposed within a first portion of a housing, and a switch assembly disposed within the interior of a second portion of the housing. The motion converter is comprised of a lever having one end adapted to engage the device, and a shaft assembly having one portion thereof attached to the other end of the lever and another portion thereof for providing a switch motion to open and close contacts of the switch assembly upon movement of the shaft assembly and the lever. A first means is provided for restoring the shaft assembly towards its initial position from a position within a range defined by a first predetermined position and the initial position of the shaft assembly. A second means is provided for restoring the shaft assembly towards its initial position if the shaft assembly exceeds the above defined range. The second restoring means is comprised of a member having a camming section mounted on the shaft assembly, and at least one spring loaded plug for engaging the camming section when movement of the shaft assembly exceeds the above defined range.

9 Claims, 4 Drawing Figures

LEVER OPERATED LIMIT SWITCH HAVING A MECHANISM TO INCREASE OVERTRAVEL

BACKGROUND OF THE INVENTION

1. Field of the Invention

This invention relates to limit switches, and, more particularly, to a rotary lever operated limit switch having mechanism for increasing the degree of permissible overtravel during the course of a monitoring or sensing operation.

2. Description of the Prior Art

Rotary lever operated limit switches have been described in U.S. Pat. Nos. 3,252,345; 3,539,738; and 3,829,637 as having a head and a body portion fastened together. A shaft assembly is positioned within the head portion and an externally extending end thereof is attached to the lever. The body portion includes a switch, and the head portion includes a camming mechanism coupled to the shaft assembly to operate the switch in accordance with the rotary motion of the shaft assembly and the lever. After the shaft assembly has moved from its initial position to an actuating position in response to movement of the lever by a device being sensed, a mechanism is provided to return the shaft assembly to its initial position. This mechanism, which is described in the above referred to patents, is comprised of a spring loaded plunger which engages a flat cut away portion of the shaft assembly. In operation, as the shaft assembly is rotated from its initial position during a sensing operation, the plunger is forced to move upward into a recess within the head of the housing, and as the lever is released by the device, the plunger imparts a torque to the flat portion of the shaft assembly in a direction to return the shaft assembly to its initial position, whereupon a surface of the plunger presses against the flat portion of the shaft assembly. However, if the lever and shaft are moved approximately more than 60° from its initial position, it is not always certain whether the plunger will be able to impart sufficient torque to the flat portion of the shaft assembly to return the shaft assembly to its initial position, since displacement of the shaft assembly beyond this 60° position may cause the plunger to bear more against the circumference of the shaft assembly than against the flat portion of the shaft assembly. Thus, although the switch can be operated reliably within the range defined by the initial position and a 60° angle of displacement of the shaft assembly, the overtravel which can be imparted to the lever and shaft assembly of the limit switch, while still enabling reliable operation of the switch, is thus undesirably limited. This limitation is undesirable, since the user of the limit switch is forced to be more precise in his installation of the switch in order to avoid damage to his equipment, if the switch is inadvertently or occassionally operated beyond this limit. Thus, in order to use this limit switch in many operations, great expense may be incurred by the user in order to precisely limit the maximum angular travel of the lever and shaft assembly of the limit switch.

OBJECT OF THE INVENTION

It is therefore an object of this invention to provide for an improved rotary lever operated limit switch which has an increased permissible range of overtravel that can be imparted to the lever and shaft assembly without adversely affecting the reliability of operation of the limit switch.

Other objects of the invention will be pointed out hereinafter.

SUMMARY OF THE INVENTION

According to a broad aspect of the invention there is provided an improved rotary limit switch for indicating when a device reaches a limiting position. The limit switch is comprised of a housing having a head and a body portion. A motion converter is at least partially disposed within the head portion of the housing. The motion converter includes a lever having one end thereof adapted to engage the device, and a shaft assembly having one portion thereof attached to another end of the lever and another portion thereof for providing a switch motion upon sufficient predetermined movement, of the shaft assembly and the lever by the device, in at least a first direction from an initial position. A switch assembly is disposed within the interior of the body of the housing. The switch assembly has at least a first and a second contact and operating means for moving the first and second contacts into and out of engagement with one another. Actuating means is provided for mechanically coupling the switch motion of the motion converter to the operating means of the switch assembly. A first means is provided for restoring the shaft assembly in a second direction opposite the first direction towards the initial position from a position within a range defined by a first predetermined position and the initial position of the shaft assembly. A second means is further provided for restoring the shaft assembly in the second direction towards the initial position from a position within a range at least defined by a second predetermined position and the first predetermined position of the shaft assembly, wherein the first predetermined position is closer to the initial position than is the second predetermined position as the shaft is returning to the initial position. When the shaft is returning to the initial position from a position within the range defined by the first and second predetermined positions, the second restoring means moves the shaft assembly towards the initial position until the shaft is positioned within the range defined by the first predetermined position and the initial position, and then the first restoring means continues to move the shaft assembly toward the initial position.

The second restoring means of the limit switch is comprised of biasing means, means for maintaining the biasing means within an alcove within an interior wall of the head of the housing, and a member fixed to the shaft assembly. The member has at least one camming section which is predeterminedly positioned to engage the biasing means when the shaft assembly is positioned within the range defined by the first and second predetermined positions.

The biasing means is comprised of at least a first spring loaded plug, and means for limiting movement of the first plug to prevent the shaft assembly from moving beyond the second predetermined position. The first spring loaded plug can bias the shaft assembly towards the initial position in the clockwise direction, and the means for limiting movement of the first plug is comprised of a second spring loaded plug maintained within the alcove. The member can have another camming section which is predeterminedly positioned to move the second plug toward the first plug, whereby the second plug can bias the shaft assembly for movement in the counterclockwise direction toward the initial position, while the first plug limits the movement of the shaft assembly and the second plug in the clockwise direction.

DESCRIPTION OF A PREFERRED EMBODIMENT

Figure 1:
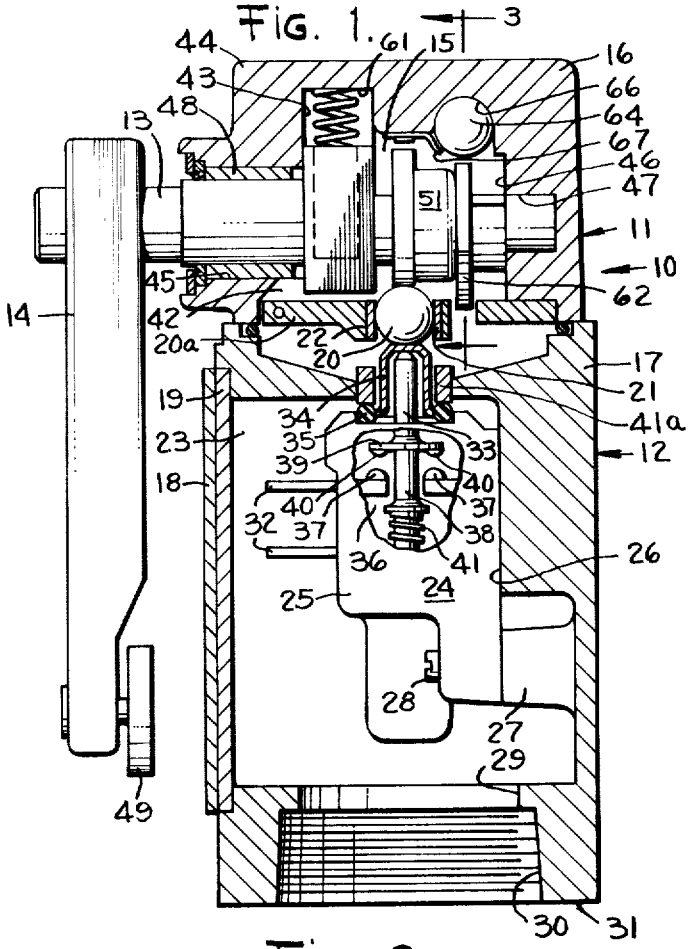
FIG. 1 is an assembled front sectional view of the limit switch detailing the invention.

Now referring to FIG. 1, there is provided a limit switch 10 which includes a first or head portion 11 which is mounted on a second or body portion 12. The particular head portion 11 illustrated in FIG. 1 includes a motion converter providing for switch actuation upon rotation by a device with which the limit switch is associated. To this end, head portion 11 includes an actuating shaft 13 having a lever 14 journaled on a protruding outer end thereof and adapted for rotary movement within a bore 15 of a housing 16.

Body portion 12 comprises a housing 17 having a cover 18 on one side thereof permitting access to the housing interior. Fastening means (not shown) extends through cover 18 into housing 17 to secure both cover 18 and a gasket 19 disposed therebetween. Housing 17 can be made to engage and be joined to housing 16 in the manner described in U.S. Pat. No. 3,539,738.

Actuating means is provided comprising a sphere 20 which is centrally disposed in a recessed portion of a bottom member 20*a* of housing 16, and adapted for free, reciprocative movement therein by a retaining means including a cylindrical bushing 21. Inasmuch as the motion converter, which may be disposed in head portion 11, includes means providing the standard switch motion, as hereinafter described, it may readily be seen that the actuating means including retained sphere 20 allows placement and orientation of the motion converter in a variety of positions relative to body portion 12. Spherical actuator 20 provides a common actuating surface in each of the positions so that the movement coupled to a switch assembly within housing 17 is in all cases identical.

Bottom member 20*a* has a bore 22 within which cylindrical bushing 21 and spherical actuator 20 are disposed. Bore 22 communicates at one end thereof with an interior cavity 23 within which is mounted a switch assembly 24. A housing 25 of assembly 24 abuts a rear surface 26 of cavity 23 and is secured to at least one projection 27 of housing 17 by a screw 28.

A second bore 29, coaxial with bore 22, provides for communication between cavity 23, and a threaded hole 30 can extend between a bottom surface 31 of housing 18 and bore 29 to receive a standard conduit.

Switch assembly 24 may be the same as described in U.S. Pat. No. 3,539,738, and may include any desired contact configuration, such as normally-opened or normally-closed contacts or any combination thereof. Electrical connection may be made to the stationary contacts of these combinations via terminals 32. Electrical leads may be soldered or otherwise secured to terminals 32 and drawn through bore 29 and the conduit inserted therein to any device capable of using the indication provided by switch assembly 24.

Movable contacts in switch assembly 24 are actuated by means of a reciprocative plunger 33 which extends approximately within cylinder bushing 21. Spherical actuator 20 engages plunger 33 through the medium of a gasket seal including a diaphragm 34 which completely surrounds plunger 33 and an O-ring surface 35 which is compressed in assembly between bushing 21 and housing 25.

In one embodiment of switch assembly 24 suitable for use in the body portion 12 of this invention there is shown a normally open switch arrangement in FIG. 1. Housing 25 is comprised of Bakelite or other insulating materials, and has disposed in an interior cavity 36 thereof a contact arrangement. A pair of stationary contacts 37 have disposed therebetween a movable contact carrier 38 attached to reciprocative plunger 33. Movable contact carrier 38 has a contact bridge 39 attached thereto, wherein movable contacts 40 are fastened to the outer edges of contact bridge 39 so as to be in juxtaposition with stationary contacts 37. A spring 41 attached to carrier 38 normally maintains carrier 38 and plunger 33 in such a raised position that movable contacts 40 do not engage stationary contacts 37. As plunger 33 is depressed due to actuation by sphere 20, movable contacts 40 are forced into engagement with stationary contacts 37.

It is to be clearly realized that the invention is not limited to the described switching mechanism and indeed may be used with a variety of switch assemblies, the only requirement being that the assembly fit within cavity 23 of housing 17. The switch can have a reciprocative plunger which may be inserted into a bushing 41*a* in housing 17.

Figure 2:
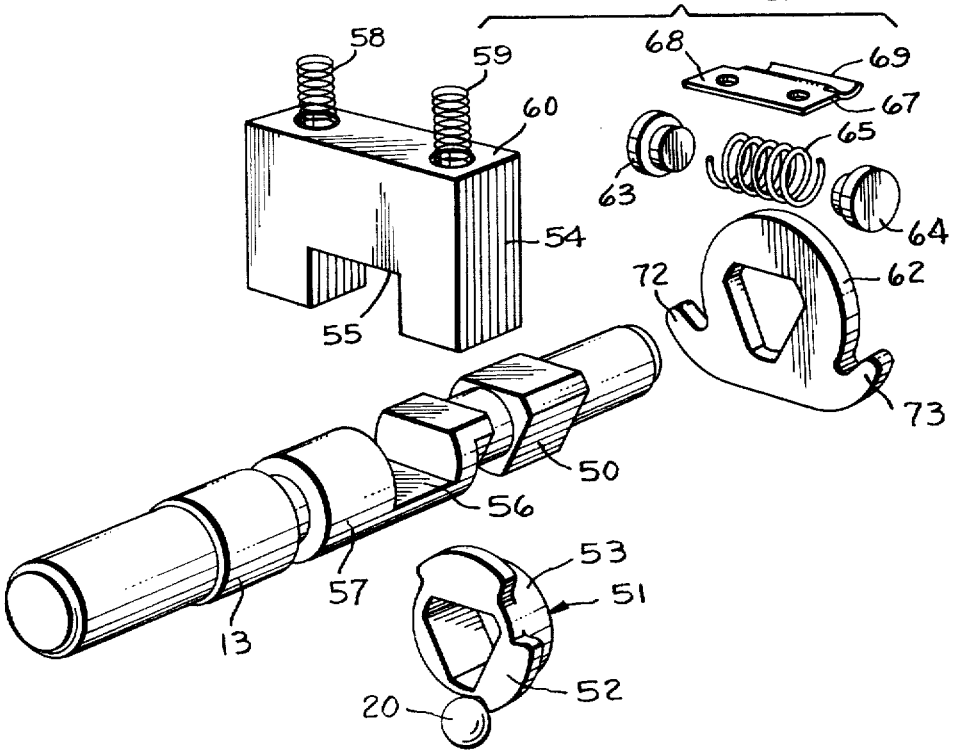
FIG. 2 is an exploded perspective view of the shaft assembly and the first and second restoring means in accordance with this invention.

The motion converter shown in FIGS. 1 and 2 is known as a lever operated rotary motion converter and generally converts a rotary motion of an operating shaft to a standard reciprocative switch-operating motion. Included within housing 16 is a cavity 42 which opens adjacent spherical actuator 20 in the assembly. Communicating with cavity 42, is a rectangular recess 43 extending into an upper portion 44 of housing 16. Extending through one side of housing 16 and into cavity 42 is a first bore 45, and coaxial therewith in a rear wall 46 of housing 16 is a second bore 47. Operating shaft 13 is rotatably journaled within bore 47, and a cylindrical sleeve is disposed within bore 45. Affixed to an outwardly projecting portion of shaft 13 is lever 14 carrying a pinned roller 49 for contact with the device with which the limit switch is associated.

Removably keyed upon a triangular shaft section 50 of operating shaft 13 is a member 51, which member is comprised of a plastic-like, metallic or any other suitable material having a camming section 52 joining an adjacent section 53 of relatively smaller diameter than that of camming section 52. Member 51 can be maintained in any one of three operating positions in the manner explained in U.S. Pat. No. 3,829,637, in order to enable actuation of the switch when the shaft is rotated in the clockwise, counterclockwise or both clockwise and counterclockwise directions.

After the device (not shown) is used to activate the limit switch by causing lever 14 to rotate shaft 13 in a first direction, a first means is provided for restoring the shaft assembly in a second direction opposite the first direction towards an initial position from a position within a range defined by a first predetermined position (in this instance an angular displacement of approximately 60° from the initial position) and the initial position of the shaft. The first restoring means is comprised of a spring loaded U-shaped saddle or plunger 54, which has a flat cut away or recessed surface 55 pressing against a flat cut away or recessed surface portion 56 of a medial cylindrical part 57 of shaft 13 when the shaft is in its initial position. A downward biasing pressure is maintained on plunger 54 by a pair of springs 58 and 59 which extend between a top surface 60 of plunger 54 and a top surface 61 bounding recess 43. Inasmuch as recess 43, plunger 54 and flat cut away surface 56 are in alignment, as the shaft is rotated from its initial position by the device, plunger 54 moves upward into recess 43. After the lever and shaft have been angularly displaced in a first direction from their initial position within the range defined by the first predetermined position and the initial position, and the lever has been disengaged from the device, spring biased plunger 54 imparts a torque to flat surface 56 of the shaft to cause the shaft and lever to return in a second direction opposite the first direction to its initial position. As stated previously, if the angular displacement of the shaft and lever is greater than, in this instance, approximately 60° from its initial position, plunger 54 continues to rise within recess 43, but it is no longer certain whether or not plunger 54 can be relied upon to supply sufficient torque to flat surface 56 of the shaft to insure that the shaft will still return to its initial position, since after the shaft has been displaced beyond the first predetermined position, the plunger begins to bear more and more upon the circumference of section 57 and less and less upon flat surface 56.

Figure 3:
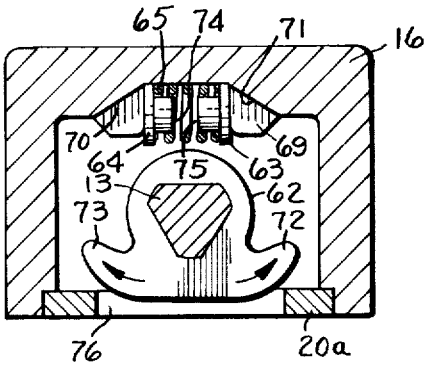
FIG. 3 is a side sectional view of the second restoring means shown in FIG. 1 taken along lines 3—3.

Therefore, in accordance with this invention, and in order to increase the permissible allowable overtravel which can be imparted to the lever and shaft, a second means is provided for restoring the shaft assembly in the second direction towards the initial position from a position within a range at least defined by a second predetermined position (in this instance the second position is at a displacement angle of approximately 90° from the initial position of the shaft) and the first predetermined position of the shaft, wherein the first predetermined position is of course closer to the initial position than is the second predetermined position as the shaft is returning to the initial position. The second restoring means is provided by a camming member 62 and a pair of spring loaded plugs 63 and 64, which plugs are normally separated by a compression spring 65. Camming member 62 is keyed and maintained on triangular portion 50 of shaft 13 and positioned adjacent to section 53 of member 51. Plugs 63 and 64 and spring 65 are normally positioned, as shown in FIG. 3, within an alcove 66 (shown in FIG. 1) which is located within an upper interior surface of housing 16 and in vertical alignment with camming member 62. The plugs and spring 65 are vertically maintained by a holding plate 67 having a first section 68 and a cup shaped second section 69. Section 68 is mounted to an upper interior wall of housing 16 adjacent alcove 66, and cup shaped section 69 extends partially beneath plugs 63 and 64 to maintain them within the alcove. Referring to FIG. 3, horizontal movement of plug 64 is limited in the leftward direction by a downwardly sloping interior wall portion 70 bounding the left side of the alcove. Similarly plug 63 is limited in movement in the rightward direction by a downwardly sloping wall portion 71 bounding the right side of the alcove. Camming member 62 is comprised of first and second camming ears 72 and 73. Camming ear 72 is predeterminedly positioned so as to engage plug 63 as soon as the angular displacement in the counterclockwise direction (referring to FIG. 3) of the shaft exceeds the first predetermined shaft position (approximately 60° from the initial position). Similarly camming ear 73 is predeterminedly positioned on camming section 62 to engage plug 64 as soon as the angular displacement in the clockwise direction (referring to FIG. 3) of the shaft exceeds the predetermined angular displacement of approximately 60° from the initial position. The maximum permissible angular displacement of the shaft in either the clockwise or counterclockwise direction defines the second predetermined angular displacement position for the shaft, and, in this instance, is approximately 90° from the initial position. The maximum displacement of shaft 13 in the clockwise direction (referring to FIG. 3) is reached when plug 64 is moved by camming ear 73 clockwise, or in the rightward direction, until an end surface 74 of plug 64 engages an end surface 75 of plug 63. Similarly, referring again to FIG. 3, the maximum counterclockwise movement of shaft 13 is reached when end surface 75 of plug 63 is moved leftward to an abutting position with end surface 74 of plug 64.

Figure 4:
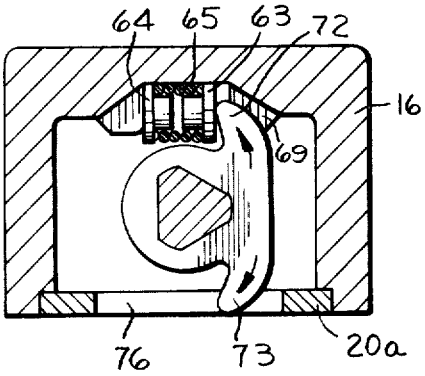
FIG. 4 is a side sectional view of the restoring means shown in FIG. 3 after the shaft assembly has been rotated sufficiently to encounter the second restoring means.

In operation, when the lever and shaft assembly are moved by the external device to actuate the switch, and the lever and shaft assembly are angularly displaced from the initial position to a position within the range defined by the first and second predetermined shaft positions (between 60° and 90° with reference to the initial position of the shaft assembly) in the counterclockwise direction, as shown in FIG. 4, camming ear 72 engages and displaces plug 63 in the leftward direction. When the external device releases the lever, spring loaded plug 63 imparts sufficient biasing force to camming ear 72 to cause shaft 13 to return towards its initial position in the clockwise direction, and approximately when camming ear 72 and plug 63 disengage, plunger 54 is biased to impart sufficient torque to flat surface 56 of shaft 13 to insure continued movement of the shaft toward its initial position. Again referring to FIGS. 3 and 4, when the shaft is angularly displaced during operation of the switch in the clockwise direction, spring loaded plug 64 and camming ear 73, in conjunction with plunger 54, imparts sufficient force to shaft 13 to return it to its initial position in an analogous fashion.

Thus, as described above, when the shaft assembly is angularly displaced within the range defined by the first and second predetermined positions (between 60° and 90° from initial position of the shaft assembly), the second restoring means satisfactorily moves the shaft assembly towards the initial position until the shaft assembly is positioned within the range defined by the first predetermined position and the initial position, and then the first restoring means continues to move the shaft assembly towards the initial position. In this manner, the extent of permissible overtravel which can be imparted to the lever of the limit switch by an external device can be significantly increased without adversely affecting continued and reliable operation of the limit switch.

At this point it should be noted that bottom member 20a of housing 16, has an elongated slot 76 therethrough, shown in FIGS. 3 and 4, for allowing unobstructed rotational movement of camming ears 72 and 73 of camming member 62 therethrough.

Although the invention has been described with reference to a specific embodiment thereof, numerous modifications are possible without departing from the invention, and it is desirable to cover all modifications falling within the spirit and scope of this invention.

What we claim as new and desire to secure by Letters Patent of the United States is:

1. A rotary limit switch for indicating when a device reaches a limiting position, comprising:

a. a housing having first and second portions;

b. a motion converter at least partially disposed within said first portion of said housing, said motion converter including a lever having one end adapted to engage the device, and a shaft assembly having one portion thereof attached to another end of said lever and another portion thereof providing a switch motion upon movement of said shaft assembly and said lever by the device, in at least a first direction from an initial position;

c. a switch assembly disposed within the interior of said second portion of said housing, said switch assembly having at least a first and a second contact and operating means for moving said first and second contacts into and out of engagement with one another;

d. actuating means mechanically coupling the switch motion of said motion converter to said operating means of said switch assembly;

e. a first means for restoring said shaft assembly in a second direction opposite the first direction towards the initial position from a position within a range defined by a first predetermined position and the initial position of said shaft; and f. a second means for restoring said shaft assembly in the second direction towards the initial position from a position within a range at least defined by a second predetermined position and the first predetermined position of said shaft, the first predetermined position being closer to the initial position than is the second predetermined position as said shaft is returning to the initial position, whereby when said shaft is returning to the initial position from a position within the range defined by the first and second predetermined positions, said second restoring means moves said shaft assembly toward the initial position until said shaft is positioned within the range defined by the first predetermined position and the initial position, and then said first restoring means continues to move said shaft assembly toward the initial position.

2. A limit switch according to claim 1, wherein said shaft assembly includes a cylindrical position having a flat surface within said cylindrical portion.

3. A limit switch according to claim 2, wherein said first portion of said housing has a recess therein extending upward from an interior wall thereof, said recess being aligned with said flat surface of said shaft assembly.

4. A limit switch according to claim 3, wherein said first restoring means is comprised of a spring loaded plunger having a surface portion pressing against said flat surface of said shaft assembly when shaft assembly is in the initial position, whereby when said shaft assembly is positioned within the range defined by the first and second predetermined positions, said plunger is forced upward into said recess within said first portion of said housing to await movement of said shaft assembly toward the initial position by said second restoring means, and when said shaft assembly is positioned within the range defined by the first predetermined position and the initial position, said spring loaded plunger imparts a torque to said flat surface of said shaft assembly to return said shaft assembly to the initial position.

5. A limit switch according to claim 1, wherein said first portion of said housing has an alcove therein extending into an interior wall thereof, and said second restoring means is comprised of:

a. biasing means;

b. means for maintaining said biasing means within said alcove; and c. a member fixed to said shaft assembly, said member having at least one camming section predeterminedly positioned to engage said biasing means when said shaft assembly is positioned within the range defined by the first and second predetermined positions.

6. A limit switch according to claim 5, wherein said biasing means is comprised of at least a first spring loaded plug, and means for limiting the movement of said first plug to prevent said shaft assembly from moving beyond the second predetermined position.

7. A limit switch according to claim 5, wherein said means for maintaining said biasing means within said alcove is comprised of a plate having a first and a second portion, said first portion of said plate being fixed to an interior part of said first portion of said housing adjacent said alcove, and said second portion of said plate extends below said alcove to block removal of said biasing means from said alcove.

8. A limit switch according to claim 6, wherein said first spring loaded plug biases said shaft assembly toward the initial position in the clockwise direction, and said means for limiting movement of said first plug is comprised of a second spring loaded plug maintained within said alcove.

9. A limit switch according to claim 8, wherein said member is comprised of another camming section predeterminedly positioned to move said second plug toward said first plug, whereby said second plug biases said shaft for movement in the counterclockwise direction toward the initial position, and said first plug limits the movement of said shaft assembly and said second plug in the clockwise direction.

* * * * *

PO-1050
(5/69)

UNITED STATES PATENT OFFICE
CERTIFICATE OF CORRECTION

Patent No. 3,931,484 Dated January 6, 1976

Inventor(s) Chace, R. L., Kilcoin, J. A. and Semonchik, W.

It is certified that error appears in the above-identified patent and that said Letters Patent are hereby corrected as shown below:

Column 7, line 55, delete "position" and insert -- portion --

Signed and Sealed this twentieth Day of April 1976

[SEAL]

Attest:

RUTH C. MASON
*Attesting Officer*

C. MARSHALL DANN
*Commissioner of Patents and Trademarks*